US007370697B1

(12) United States Patent
Sakamoto et al.

(10) Patent No.: US 7,370,697 B1
(45) Date of Patent: May 13, 2008

(54) THRUST SECTION WEAR PREVENTOR

(75) Inventors: Stephen M. Sakamoto, Oklahoma City, OK (US); Aaron Noakes, Norman, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 419 days.

(21) Appl. No.: 10/913,613

(22) Filed: Aug. 6, 2004

Related U.S. Application Data

(60) Provisional application No. 60/532,872, filed on Dec. 29, 2003.

(51) Int. Cl.
*F04B 17/00* (2006.01)

(52) U.S. Cl. ..... 166/66.4; 166/105; 417/365

(58) Field of Classification Search ..... 166/369, 166/381, 105, 106, 107, 66.4, 68; 417/365
See application file for complete search history.

(56) References Cited

U.S. PATENT DOCUMENTS 1,778,787 A * 10/1930 Arutunoff ..... 310/87
2,236,887 A * 4/1941 Arutunoff ..... 417/414
2,455,022 A * 11/1948 Schmidt ..... 417/99
3,404,924 A * 10/1968 Choate ..... 384/149
4,009,756 A * 3/1977 Zehren ..... 166/250.15
4,623,305 A * 11/1986 Segerstrom ..... 417/365
4,669,961 A * 6/1987 Lorett ..... 418/1
4,992,689 A * 2/1991 Bookout ..... 310/87
5,070,940 A * 12/1991 Conner et al. ..... 166/65.1
6,033,567 A * 3/2000 Lee et al. ..... 166/265
6,092,600 A * 7/2000 McKinzie et al. ..... 166/266
6,213,202 B1 * 4/2001 Read, Jr. ..... 166/55.1
6,242,829 B1 * 6/2001 Scarsdale ..... 310/87
6,298,917 B1 * 10/2001 Kobylinski et al. ..... 166/369
6,307,290 B1 * 10/2001 Scarsdale ..... 310/87
6,666,664 B2 * 12/2003 Gross ..... 417/423.3
6,863,124 B2 * 3/2005 Araux et al. ..... 166/66.4
7,066,248 B2 * 6/2006 Howell ..... 166/105.5
2003/0132003 A1 * 7/2003 Arauz et al. ..... 166/370
2004/0251019 A1 * 12/2004 Howell ..... 166/105.5
2005/0087343 A1 * 4/2005 Du et al. ..... 166/369
2005/0167096 A1 * 8/2005 Du et al. ..... 166/105
2006/0175064 A1 * 8/2006 Yuratich ..... 166/381

* cited by examiner

*Primary Examiner*—Jennifer H Gay
*Assistant Examiner*—Daniel P Stephenson
(74) *Attorney, Agent, or Firm*—Crowe & Dunlevy, P.C.

(57) ABSTRACT

A thrust section for use above a motor preferably includes a housing, a thrust shaft, a thrust runner connected to the thrust shaft, a thrust bearing connected to the housing, and a motor lead guard. The motor is preferably positioned above a pump assembly. The thrust runner and thrust bearing prevent upward movement of the shaft.

13 Claims, 3 Drawing Sheets

THRUST SECTION WEAR PREVENTOR

RELATED APPLICATIONS

This application claims the benefit of U.S. Provisional Patent Application No. 60/532,872, entitled Prevention of Up-Thrust Wear on Center Tandem ESP Motors, filed Dec. 29, 2003, which is herein incorporated by reference.

FIELD OF THE INVENTION

This invention relates generally to the field of downhole pumping systems, and more particularly to an apparatus for protecting motors from wear caused by up thrust.

BACKGROUND

Submersible pumping systems are often deployed into wells to recover petroleum fluids from subterranean reservoirs. Typically, a submersible pumping system includes a number of components, including one or more electric motors coupled to one or more pump assemblies. The submersible pumping systems deliver the petroleum fluids from the subterranean reservoir to a storage facility on the surface. Each of the components in a submersible pumping system must be engineered to withstand the inhospitable downhole environment.

Submersible pumping systems can be attached to the end of production tubing or coiled tubing to deliver fluids to the surface. Various configurations of the components in the submersible pumping system may be used based on the type of delivery system and on various well conditions. For example, some submersible pumping systems that use production tubing through which to deliver fluids to the surface employ a pump above the motor (top intake). Conversely, some submersible pumping systems that employ coiled tubing and that utilize well casing to deliver fluids to the surface employ a pump below the motor (bottom intake).

Referring now to FIG. 1, shown therein is a prior art submersible pumping system 200 in a top intake configuration. The submersible pumping system 200 is disposed within a well annulus 202, and includes a motor assembly 204, a seal section 206 and a pump assembly 208. A power cable 210 extends from the surface through the annulus 202 and connects to the motor assembly 204.

During operation a shaft (not shown) in the motor assembly 204 rotates and drives a shaft (not shown) in the seal section 206, which in turn drives the pump assembly 208 to propel well fluid through the production tubing 212.

It is well known that during startup of a submersible pumping system, the motor shaft tends to rise, an effect known as "up thrust." In top intake applications this problem is diminished by use of the seal section 206 between the motor assembly 204 and the pump assembly 208, which not only facilitates motor lubricating oil expansion and contraction, but also prevents upward movement of the motor shaft. However, in bottom intake applications the seal section is positioned below the motor and therefore is unable to prevent the motor shaft from moving upward during startup. This problem is more pronounced in horizontal wells since the effect of gravity is virtually eliminated from holding down the motor shaft.

The rising motor shaft causes wear on various components of the motor and causes excessive wear on motor bearings. Motors are typically fitted with a radial bearing at the upper end of the motor, and these upper bearings frequently take the brunt of the up thrust generated during startup. Excessive wear on the upper bearings can cause the bearings to fail and can ultimately result in failure of the motor.

It is therefore desirable to control the effects of up thrust in a motor, especially in configurations of submersible pumping systems that are susceptible to excessive wear such as bottom intake systems in deviated wells. It is to these and other deficiencies in the prior art that the present invention is directed.

SUMMARY OF THE INVENTION

In a preferred embodiment, the present invention provides a thrust section for use above a motor, which is positioned above a pump assembly. The thrust section preferably includes a thrust shaft and a thrust protector. The thrust protector is connected to the thrust shaft and prevents upward movement of the thrust shaft.

In a preferred use, the thrust section can be used in a submersible pumping system. In another preferred use, the thrust section is used in conjunction with a coiled tubing assembly. In yet another preferred use, the thrust section is used in a bottom intake submersible pumping system. These and various other features and advantages that characterize the present invention will be apparent from the following description, drawings and claims.

DETAILED DESCRIPTION OF THE PREFERRED EMBODIMENT

Figure 1:
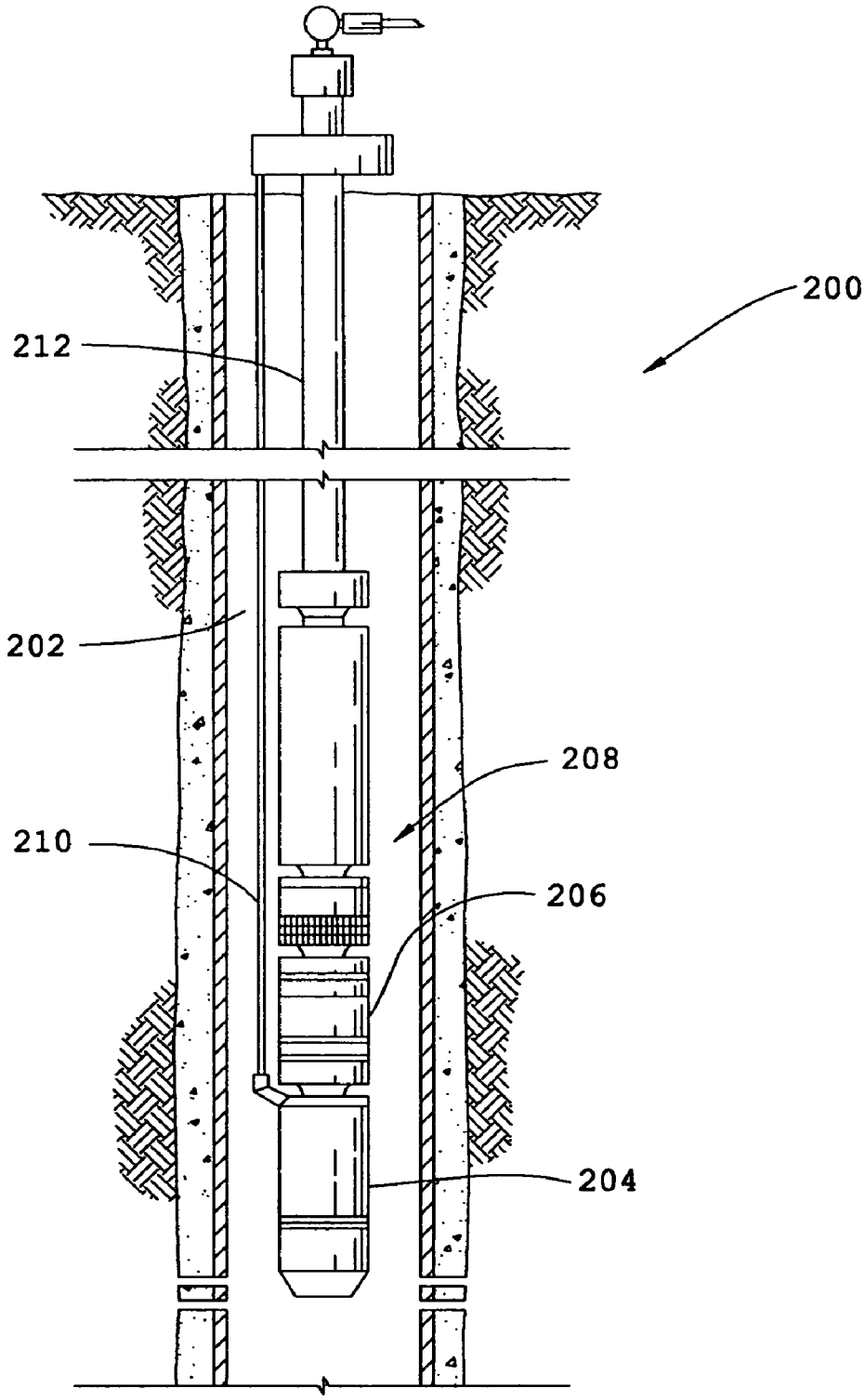
FIG.1 Prior Art
FIG. 1 is an elevational view of a prior art submersible pumping system disposed in a wellbore.
Figure 2:
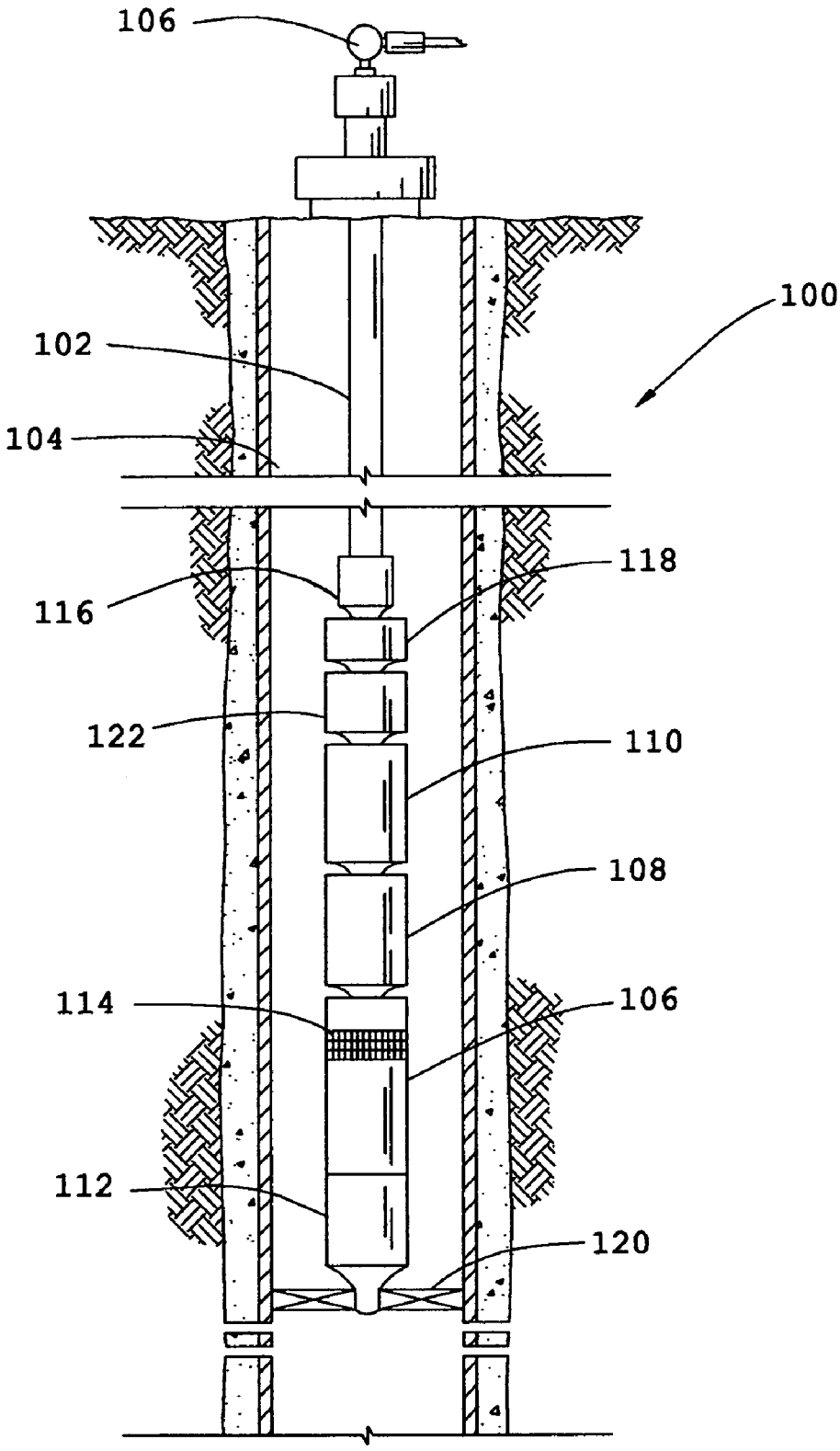
FIG. 2 is an elevational view of a submersible pumping system disposed in a wellbore in accordance with a preferred embodiment of the present invention.

In accordance with a preferred embodiment of the present invention, FIG. 2 shows an elevational view of a pumping system 100 attached to coiled tubing 102. The pumping system 100 and coiled tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The coiled tubing 102 connects the pumping system 100 to the surface and supplies power to the pumping system 100 by use of a power cable (not shown) that extends through the coiled tubing 102. Although the pumping system 100 is primarily designed to pump petroleum products, it will be understood that the present invention can also be used to move other fluids. Also, it will be understood that the present invention can be used with production tubing instead of coiled tubing 102.

The pumping system 100 preferably includes some combination of a pump assembly 106, a seal section 108, and a motor assembly 110. The pump assembly 106 includes an intake 112 and a discharge 114. The seal section 108 facilitates lubricating oil contraction and expansion in the motor assembly 110. Although only one pump assembly 106 and one motor assembly 110 are shown, it will be understood that additional pumps and motors can be connected within the submersible pumping system 100 to meet the requirements of particular applications.

Still referring to FIG. 2, the submersible pumping system 100 is shown to include a coiled tubing connector 116 and a motor interface connector 118. The coiled tubing connector 116 and the motor interface connector 118 provide a means for transitioning the coiled tubing 102 to other components of the submersible pumping system 100.

A packer 120 is positioned in the wellbore 104 as shown in FIG. 2 to separate zones in the wellbore 104. By positioning the packer 120 in the location shown in FIG. 2, well fluids can be produced from below the packer 120. Fluids below the packer 120 enter the pump assembly 106 through intake 112 during operation of the submersible pumping system 100 and exit at the discharge 114 above the packer 120. The wellbore fluids are therefore moved to the surface through space in the wellbore 104, also known as the "annulus."

As noted above, at startup of the submersible pumping system 100 the shaft of the motor assembly 110 tends to rise, causing components of the motor assembly 110 to wear. To protect against the unwanted wear, the submersible pumping system 100 of the present invention includes a thrust section 122 connected between the motor assembly 110 and the motor interface connector 118.

Figure 3:
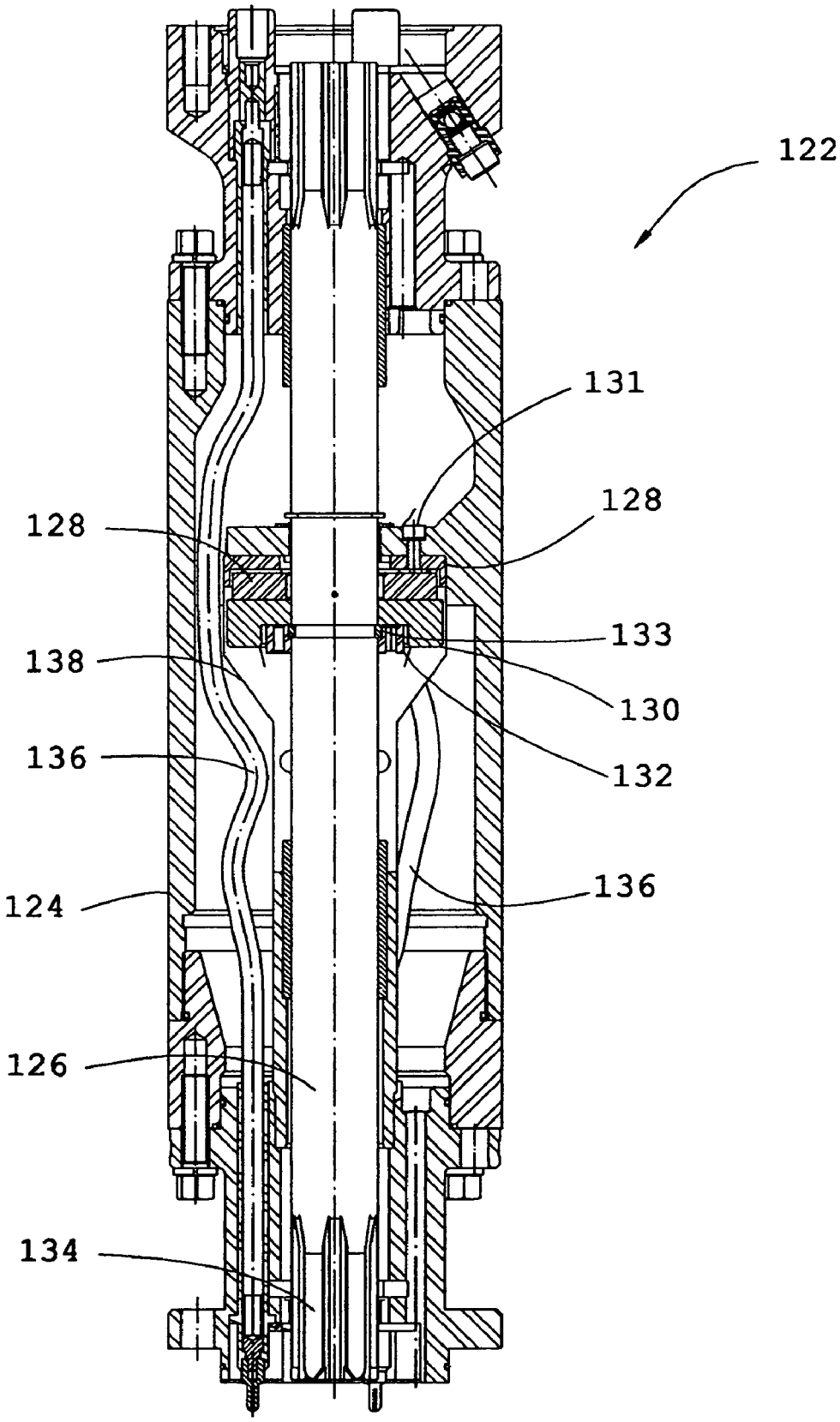
FIG. 3 is an elevational view of a cross section of a thrust protector constructed in accordance with a preferred embodiment of the present invention.

Turning to FIG. 3, shown therein is cutaway view of the thrust section 122. Preferably the thrust section 122 includes a housing 124, a thrust shaft 126, a thrust bearing 128 and a thrust runner 130. The thrust bearing 128 and the thrust runner 130 collectively form a "thrust protector assembly." The thrust bearing 128 is preferably affixed to the housing 124 with fastener 131 such as a hex head screw or bolt. The thrust runner 130 is preferably affixed to the thrust shaft 126 with an anti-rotation key (not shown), a retaining ring 132, and a two piece ring 133. The thrust shaft 126 is coupled to the motor assembly 110 at end 134, and the thrust shaft 126 and the thrust runner 130 rotate as the shaft of the motor rotates. The thrust bearing 128 remains stationary with the housing 124.

At startup the tendency of the motor shaft to rise is prevented by the thrust bearing 128 and thrust runner 130, which prevent upward axial movement of the thrust shaft 126. Because the motor shaft and the thrust shaft 126 are coupled end-to-end, when the thrust shaft 126 is held in an axial position the motor shaft is also held in position.

In other preferred embodiments, the thrust section 122 also includes one or more motor lead connectors 136 and a motor lead guard 138. The motor lead connectors 136 continue the electrical connection through the thrust section 122 so that power supplied from the surface can reach the motor assembly 110. Three motor lead connectors 136 are preferably included in the thrust section 122, one each for three phase power.

The motor lead guard 138 is preferably made of aluminum or other metal that surrounds the thrust shaft 126 and the thrust runner 130 to protect the motor lead connectors 136. Separating the thrust shaft 126 and the thrust runner 130 from the motor lead connectors 136 prevents the rotating thrust shaft 126 and thrust runner 130 from causing wear on the motor lead connectors 136 that could result in the loss of power. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A thrust section for use above a motor, wherein the motor is positioned above a pump assembly, the thrust section comprising:
- a housing;
- a thrust shaft;
- a thrust runner connected to the thrust shaft;
- a thrust bearing connected to the housing;
- a motor lead connector; and
- a motor lead guard configured to protect the motor lead connector against contact with the thrust shaft.

2. The thrust section of claim 1, wherein the thrust section is adapted to connect between a coiled tubing connector and the motor.

3. The thrust section of claim 1, wherein the motor comprises a motor shaft and wherein the thrust shaft is coupled to the motor shaft.

4. A submersible pumping system comprising:
- a motor;
- a power cable connected to the motor;
- a pump assembly below the motor;
- a seal section between the pump assembly and the motor; and
- a thrust section above the motor.

5. The submersible pumping system of claim 4, wherein the thrust section comprises:
- a housing;
- a thrust shaft;
- a thrust runner connected to the thrust shaft; and
- a thrust bearing connected to the housing.

6. The submersible pumping system of claim 4, the thrust section further comprising a motor lead connector that connects the power cable to the motor.

7. The submersible pumping system of claim 4, the thrust section further comprising a motor lead guard.

8. The submersible pumping system of claim 4, wherein the thrust protector is adapted to connect between a coiled tubing assembly and the motor.

9. The submersible pumping system of claim 4, wherein the thrust shaft is coupled to a shaft in the motor.

10. A submersible pumping system comprising:
- a motor having a motor shaft;
- a pump assembly below the motor; and
- a thrust section above the motor, the thrust section comprising:
  - a thrust shaft;
  - a thrust runner connected to the thrust shaft;
  - a thrust bearing connected to the housing;
  - a motor lead connector; and
  - a motor lead guard configured to protect the motor lead connector against contact with the thrust shaft.

11. The submersible pumping system of claim 10, wherein the thrust section is adapted to connect between a coiled tubing connector and the motor.

12. The submersible pumping system of claim 10, wherein the thrust shaft is coupled to the motor shaft.

13. A submersible pumping system, comprising:
- a motor;
- a pump below the motor;
- a seal section between the motor and the pump; and
- means for protecting the motor from up thrust.

* * * * *